US006477806B1

(12) United States Patent
Asada et al.

(10) Patent No.: US 6,477,806 B1
(45) **Date of Patent: *Nov. 12, 2002**

(54) DEVICE FOR OPENING AND CLOSING VEHICLE SLIDE DOOR WINDOW

(75) Inventors: Sukekazu Asada, Obu (JP); Yukio Isomura, Anjo (JP); Hirokazu Suzumura, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/435,991

(22) Filed: Nov. 8, 1999

(30) Foreign Application Priority Data

Nov. 6, 1998 (JP) ..... 10-315498

(51) Int. Cl.[7] ..... E05D 15/48

(52) U.S. Cl. ..... 49/169; 49/168; 49/163; 49/360; 49/26; 296/146.2; 296/146.4; 296/155

(58) Field of Search ..... 49/348, 349, 350, 49/26, 28, 360, 142, 163, 168, 169; 296/146.2, 155, 146.4

(56) References Cited

U.S. PATENT DOCUMENTS 3,742,646 A * 7/1973 Diech ..... 49/28
5,461,826 A * 10/1995 Heckel et al. ..... 49/28
5,950,365 A * 9/1999 Lieb et al. ..... 49/28

FOREIGN PATENT DOCUMENTS

| | | | | |
|---|---|---|---|---|
| EP | 357543 | * | 3/1990 | ..... 296/155 |
| JP | 77320 | * | 3/1990 | ..... 296/155 |
| JP | 10-58980 | | 3/1998 | |
| JP | 145288 | * | 5/2000 | ..... 49/351 |

* cited by examiner

*Primary Examiner*—Jerry Redman
(74) *Attorney, Agent, or Firm*—Burns, Doane, Swecker & Mathis, LLP

(57) ABSTRACT

A device for opening and closing a window portion of a slide door includes a window regulator mechanism having a lift arm whose opposite end portions are connected to a pane and a driving mechanism respectively for moving the pane in the upward and downward directions when the driving mechanism rotates the lift lever in opposite directions. An opening condition detection mechanism has a movable member associated with the lift arm so as to be movable together with the lift lever and a detection member linked to the movable member for indicating whether or not the window portion is closed by the pane.

24 Claims, 5 Drawing Sheets

DEVICE FOR OPENING AND CLOSING VEHICLE SLIDE DOOR WINDOW

This application is based on and claims priority under 35 U.S.C. §119 with respect to Japanese Application No. 10(1998)-315498 filed on Nov. 6, 1999, the entire content of which is incorporated herein by reference.

FIELD OF THE INVENTION

The present invention is directed to vehicle windows. More particularly, the present invention pertains to a device for opening and closing a vehicle slide door window.

BACKGROUND OF THE INVENTION

An example of a device for opening and closing a vehicle slide door window is disclosed in Japanese Patent Laid-Open Publication No. Hei. 10(1998)-58980 published on Mar. 3, 1998 without examination. The device is provided with a window regulator mechanism which includes a lift arm whose end portions are connected to a window pane and a driving mechanism, respectively. When the driving mechanism rotates the lift lever in opposite directions, the resulting rotation of the lift lever raises and lowers the pane, thereby opening and closing the window portion of the slide door. In addition, inside the slide door, in a space which is not occupied with the window regulator mechanism, there is provided an opening condition detection mechanism mounted on one of an impact beam and a lower frame forming parts of the slide door. The opening condition detection mechanism includes a movable member that is adapted to engage the lower end of the pane moved in the vertical direction by the foregoing device, an urging member associated with the movable member, and a detection member under action of the urging member. The opening condition detection mechanism detects the opening condition of the pane on the basis of the movement of the detection member which is linked to the movable member.

Inside the slide door, the opening condition detection mechanism is connected to the aforementioned mounting part of the slide door and occupies a space different from that of the window regulator mechanism. Moreover, the opening condition detection mechanism is configured to detect the opening condition of the pane in such a manner that the detection member is moved by the movable member engaged with the lower end of the pane. Thus, the precision of the opening condition detection mechanism is influenced or affected by the profile of the pane, the profile of the aforementioned mounting part of the slide door, and the variation resulting from the position error upon mounting the opening condition detection mechanism on the mounting element of the slide door. This can lead to poor detection precision performance of the opening condition detection mechanism.

Accordingly, a need exists for a device for opening and closing a window portion of a slide door that is not susceptible of the same disadvantages and drawbacks associated with other known devices of this type.

It would thus be desirable to provide a device for opening and closing a window portion of a slide door in which the opening condition detection mechanism possesses improved detection precision performance relative to other known devices.

SUMMARY OF THE INVENTION

In light of the foregoing, the present invention provides a device for opening and closing a window portion in a slide door of a vehicle that includes a window regulator mechanism and an opening condition detection mechanism. The window regulator mechanism includes a lift arm having opposite end portions connected to a pane and a driving mechanism for moving the pane in downward and upward directions when the driving mechanism rotates the lift arm in opposite directions to effect opening and closing of the window portion. The opening condition detection mechanism includes a movable member operatively associated with the lift arm for movement together with the lift arm, and a detection member linked to the movable member to indicate whether or not the window portion is closed by the pane.

According to another aspect of the invention, a device for opening and closing a window portion in a slide door of a vehicle includes a window pane movable in downward and upward directions to open and close the window portion, a rotatable lift arm connected to the pane, and a driving mechanism operatively connected to the lift arm to rotate the lift arm in opposite directions and cause the pane to move in the downward and upward directions to effect opening and closing of the window portion. A detection member detects whether the window portion is closed and a movable member is operatively associated with both the lift arm and the detection member. The movable member moves when the lift arm rotates in a direction causing the pane to move downward for opening the window portion and causes the detection member to detect that the window portion is other than closed.

BRIEF DESCRIPTION OF THE DRAWING FIGURES

The foregoing and additional features of the present invention will become more apparent from the following detailed description considered with reference to the accompanying drawing figures in which like elements are designated by like reference numerals and wherein.

DETAILED DESCRIPTION OF THE INVENTION

Figure 1:
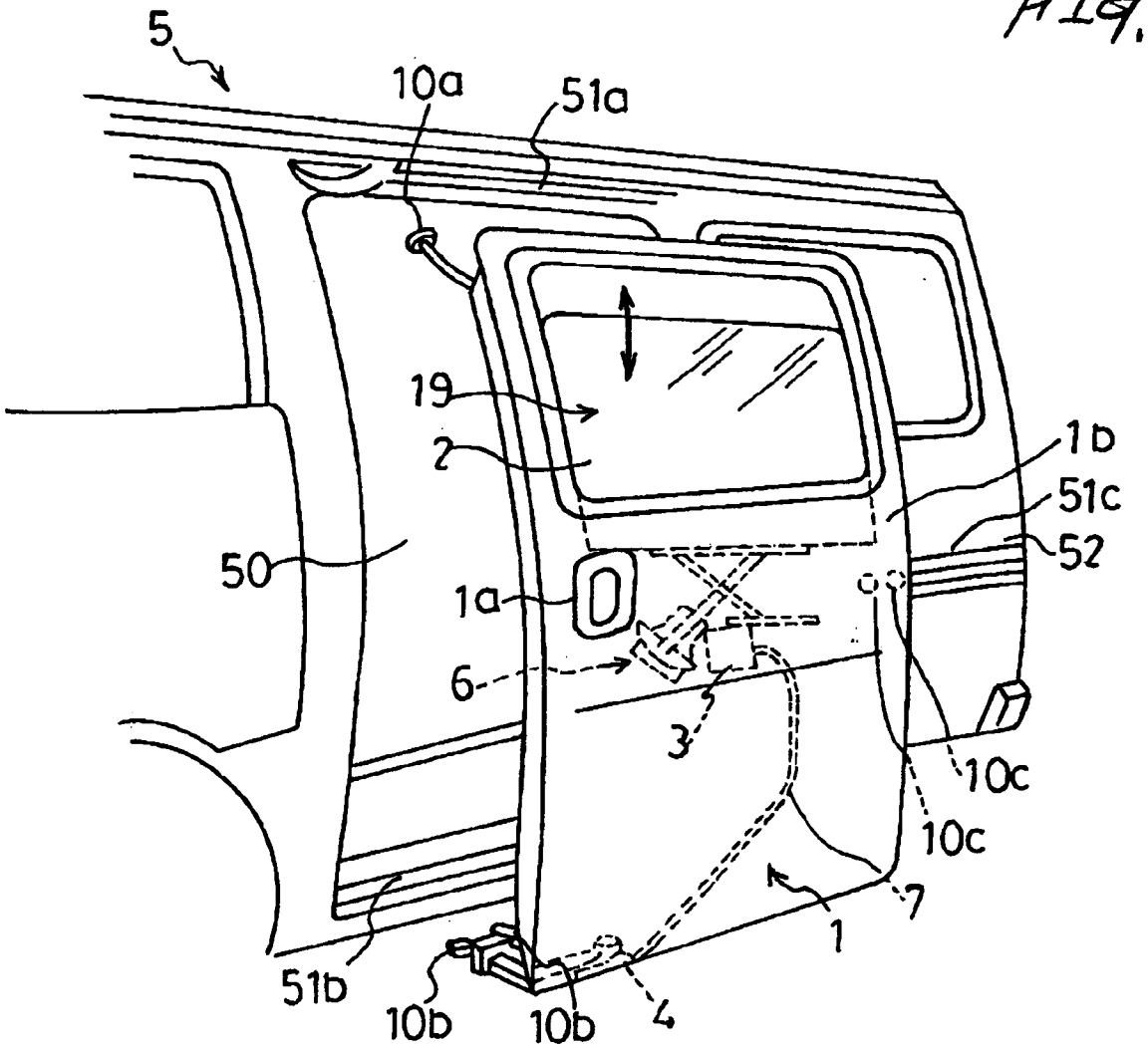
FIG. 1 is a perspective of a vehicle slide door on which is mounted a window-opening/closing device according to a first embodiment of the present invention.

FIG. 1 illustrates the rear portion of a van-type vehicle 5. An opening 50 is formed in the lateral side of the vehicle 5 to permit passengers or occupants to enter and exit the vehicle. The opening 50 is opened and closed by a slide door 1. The upper portion of the slide door 1 is outfitted with a window portion 19 that is opened and closed by a window glass or pane 2. The pane 2 is movable in the upward and downward directions under the driving action of a window regulator mechanism 6. The window regulator mechanism 6 is provided with an opening condition detection mechanism 3 which senses that the amount of downward displacement of the pane 2 has reached a set value from a fully closing position (i.e., a position at which the window portion 19 is fully closed by the pane 2).

The lower portion of the slide door 1 is provided with a stopper mechanism 4 which is connected via a connecting cable 7 to the opening condition detection sensor 3. The window regulator mechanism 6 and the opening condition detection sensor 3 constitute a device for opening and closing the vehicle slide door window.

The slide door 1 is mounted on a lateral side of the vehicle 5 so as to be movable along the lengthwise direction of the vehicle. For establishing this movement, three guide roller mechanisms are provided. The guide roller mechanisms include an upper guide roller 10*a* which is placed above the front edge 1*a* of the slide door 1, a pair of lower guide rollers 10*b*, 10*b* provided at the lower edge of the slide door 1, and a pair of center guide rollers 10*c*, 10*c* positioned generally at the center portion of the slide door 1 with respect to the height-wise extent. The body of the vehicle S is provided with an upper guide rail 51*a* located at the upper side of the opening 50 for guiding the upper guide roller 10*a*, a lower guide rail 51*b* located at the lower side of the opening 50 for guiding the pair of lower guide rollers 10*b*, 10*b*, and a center guide rail 51*c* located at the vehicle rear side portion 52 for guiding the pair of center guide rollers 10*c*.

Figure 2:
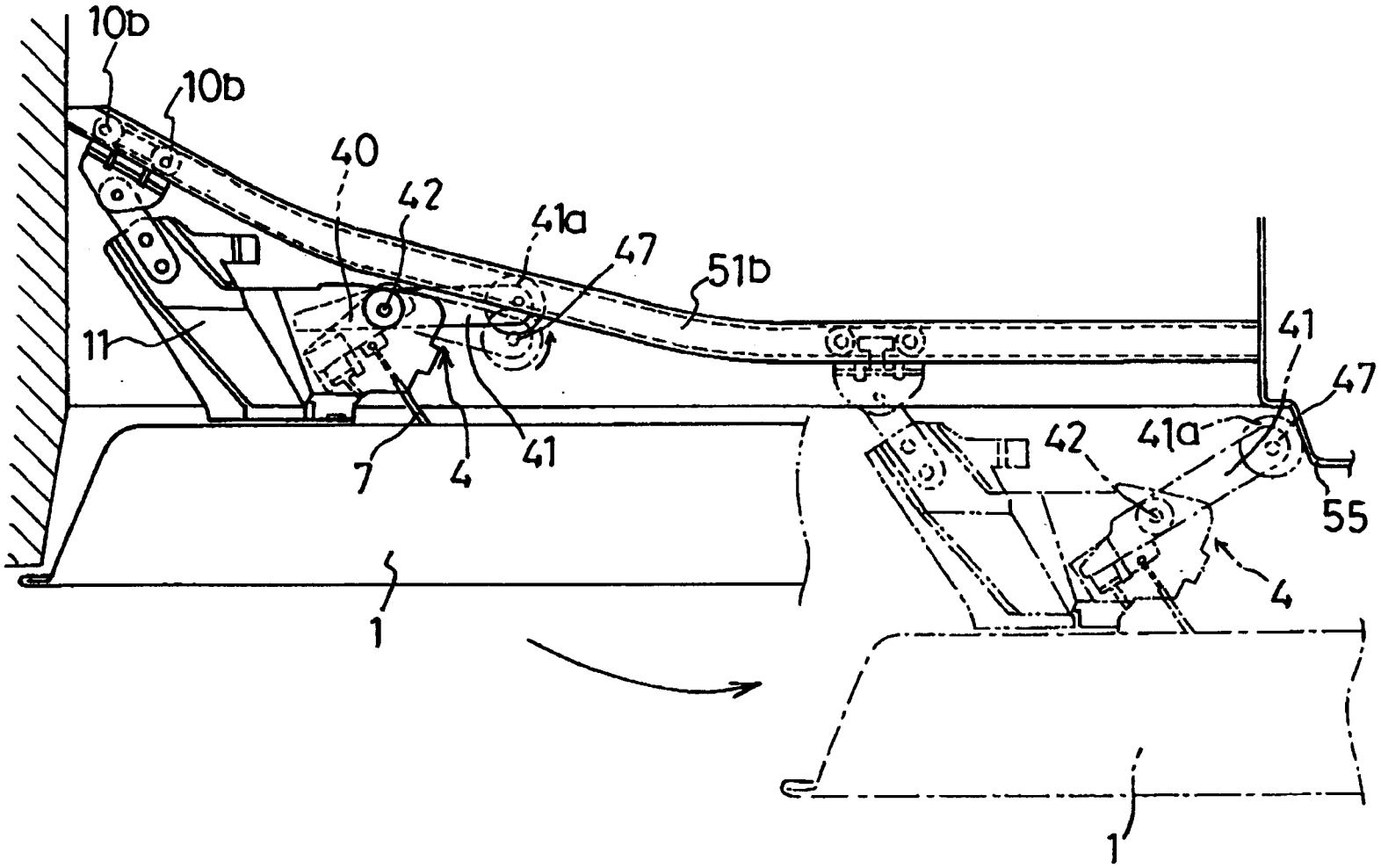
FIG. 2 is a front view of a stopper mechanism which becomes active when associated with the window-opening/closing device according to the first embodiment of the present invention.

As best shown in FIG. 2, the stopper mechanism 4 is mounted on a fixed bracket 11 by which the pair of center rollers 10*b*, 10*b* is supported on the slide door 1. The stopper mechanism 4 includes a first rotation lever 40 which is connected to the connecting cable 7 and a second rotation lever 41 which is rotatable together with the first rotation lever 40.

The first rotation lever 40 and the second rotation lever 41 are pivotally connected by a common pin 42 to the fixed bracket 11 so as to be rotatable in the horizontal plane. One end portion of the second rotation lever 41 is pivoted by a shaft 47 with a roller 41*a* which is in rolling engagement with the lower guide rail 51*b*. The second rotation lever 41 is continuously urged by a spring to establish an engagement between the roller 41*a* and the lower guide rail 51*b*.

With the foregoing structure, so long as the connecting cable 7 is not pulled by the opening condition detection mechanism 3, as depicted in dotted line in FIG. 2, the roller 41*a* is close to the slide door 1. Thus, even though the slide door 1 is moved in the rearward direction from its fully closing position, the roller 41*a* does not contact a wall portion 55 of the vehicle body. When the opening condition detection sensor mechanism 3 pulls the connecting cable 7, the first rotation lever 40 and the second rotation lever 41 of the stopper mechanism 3 are rotated. Then, the roller 41*a* is transferred inwardly along the vehicle-body lateral direction from the one-dotted line position depicted in FIG. 2, thereby being moved far away from the slide door 1 as depicted in real line in FIG. 2. Thus, moving the slide door 1 in the rearward direction of the vehicle results in that the roller 41*a* is brought into engagement with the wall portion 55 of the vehicle body, which prevents further movement of the slide door 1 in the vehicle rear direction, thereby not establishing the fully opened condition of the slide door 1.

Figure 3:
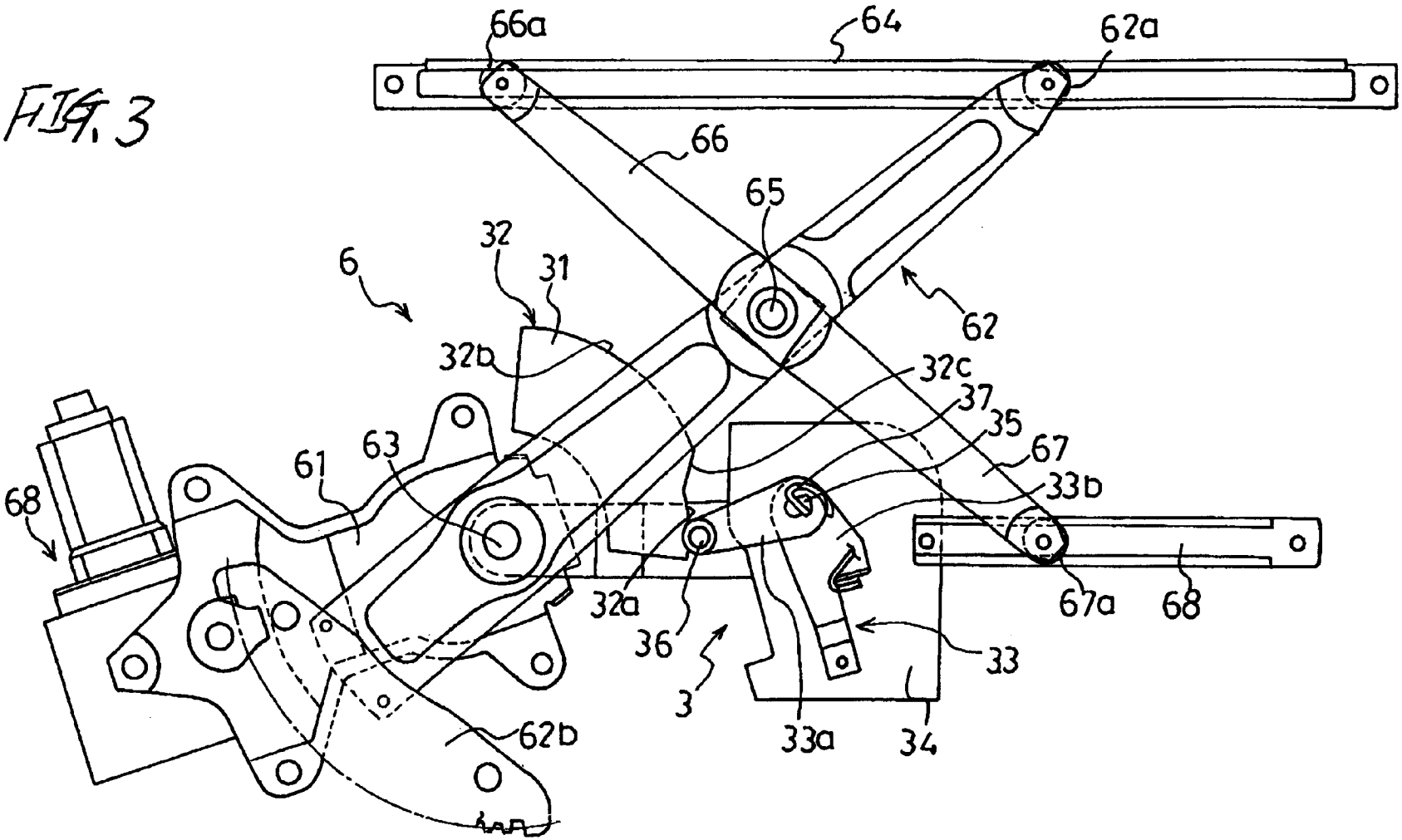
FIG. 3 is a front view of the window-opening/closing device according to the first embodiment of the present invention.

As shown in FIG. 3, the window regulator mechanism 6 which is accommodated in the slide door 1 includes a base plate 61 which is connected to a panel of the slide door 1. The base plate 61 forms a unitary structure of the window regulator mechanism 6.

A lift arm 62 is rotatably supported on the base plate 61 by a pin 63. One end portion of the lift arm 62 is provided with a roller 62*a* which slidably engages a rail 64 connected to the lower end of the pane 2. A pin 65 is provided at a substantially central portion of the lift arm 62. Two equalizer arms 66, 67 are also provided, with one end of each equalizer arm being rotatably mounted on the pin 65. The other end of one equalizer arm 66 is provided with a roller 66*a* which slidably engages the rail 64, while the other end of the other equalizer arm 67 is provided with a roller 67*a* which slidably engages a rail 68 that is secured to the panel of the slide door 1.

A driving mechanism 68 is supported on the base plate 61. The driving mechanism includes, among other known features, a motor serving as a driving source and a speed reduction gear train. The other end portion of the lift arm 62 is secured to a sector gear 62*b* which is in meshing engagement with an output pinion gear (not shown) of the driving mechanism 68.

If the motor of the driving mechanism 68 is turned on, the rotation of the pinion gear which is in meshing engagement with the sector gear 62*b* causes rotation of the lift arm 62 about the pin 63, which brings about vertical movement of the pane 2 which is guided through an up-down guide mechanism (not shown). As a result, the window portion 19 of the slide door 1 is opened. Operating the motor in the reverse direction causes upward movement or closure of the window portion 19 of the slide door 1. While the lift arm 62 is rotating, the roller 62*a* at its one end portion slides along the rail 64, thereby compensating for a difference or deviation between the locus of the lift arm 62 under rotation and the locus of the pane 2 under movement. The equalizer arms 66, 67 prevent inclination of the rail 64.

The opening condition detection sensor mechanism 3 is unitized in the window regulator mechanism 6 and includes a cam plate 31 and a detection lever 33. The cam plate 31 is secured to the lift arm 62 by welding or other means. The cam plate 31 is, as a whole, configured to be a substantially sector shaped with a rotation center that is coincident with the pin 63. The cam plate 31 is provided at its outer periphery with a cam surface 32 which changes in width in the radial direction so that the cam surface has a larger width portion 32*b* , a smaller width portion 32*a* , and a stepped portion 32*c* arranged in the circumferential direction, with the stepped portion 32*c* being disposed between the larger width portion 32*b* and the smaller width portion 32*a*.

The detection lever 33 is rotatably mounted on a pin 35 that is fixed to a bracket 34 secured to both the rail 68 and the base plate 61. The detection lever 33 includes two link members 33*a*, 33*b* arranged to form a substantially right angle between each other. The link members 33*a*, 33*b* are rotatable on the pin 35. The distal end of one link member 33*a* is provided with a roller 36 which slidably engages the cam surface 32 of the cam plate 31, while the distal end of the other link member 33*b* is connected to the connecting cable 7. A spiral spring 37 is mounted on the pin 35 in such a manner that one end of the spiral spring 37 engages the pin 35 while the other end of the spiral spring 37 engages the link member 33*b* of the detection lever 33. Thus, the link members 33*a*, 33*b* of the detection lever 33 are united by means of the spiral spring 37, thereby enabling concurrent rotations of the link members 33*a*, 33*b*. The link members 33*a*, 33*b* forming the detection lever 33 are under the continual bias action of the spiral spring 37 or an initial torque of the spring 37, thereby being rotated continually in the clockwise direction in FIG. 3 to contact the roller 36 with the cam surface 32 of the cam plate 31. Thus, the roller 36 is in continual engagement with the cam surface 32 of the cam plate 31.

While the window portion 19 of the slide door 1 is fully closed by the pane 2, as apparent from the depiction in FIG. 3, the roller 36 on the detection lever 33 is in engagement with the smaller width portion 32*a* of the cam surface 32 of the cam plate 31. If the window regulator 6 is driven to lower the pane 2 for the purposes of opening the window portion 19, the lift arm 62 rotates in the clockwise direction in FIG. 3. The link member 33*a* thus moves in the clockwise direction under the biasing force of the spring 37 to move the roller 36, which is in engagement with the smaller width portion 32*a*, into engagement with the larger width portion 32*b* by riding through the stepped portion 32*c* of the cam surface 32. Thus, the detection lever 33 is rotated in the clockwise direction in FIG. 3, and this pulls the connecting member or connecting cable 7 to initiate the stopper mechanism 4. As mentioned above, the pulling of the connecting cable 7 prevents the slide door 1 from being brought into its fully opened condition. In other words, so long as the window portion 19 is opened, the fully opened condition of the slide door 1 cannot be established, which makes it possible for the occupant to relatively easily check whether the window portion 19 is opened or not. In the event the connecting cable 7 becomes immovable due to an unexpected condition, the link member 33*a* of the detection lever 33 causes the spiral spring 37 to bend or deflect, thereby allowing relative rotation of the link members 33*a*, 33*b* with respect to each other. If the two link members 33*a*, 33*b* were directly connected to one another and the connecting cable 7 became immovable, the link member 33*a* would be deformed by the moving force from the cam plate 31. Thus, the spring 37 interposed between the link members 33*a*, 33*b* allows the link member 33*a* to rotate relative to the link member 33*b* to prevent deformation of the detection lever 33*a*.

Figure 4:
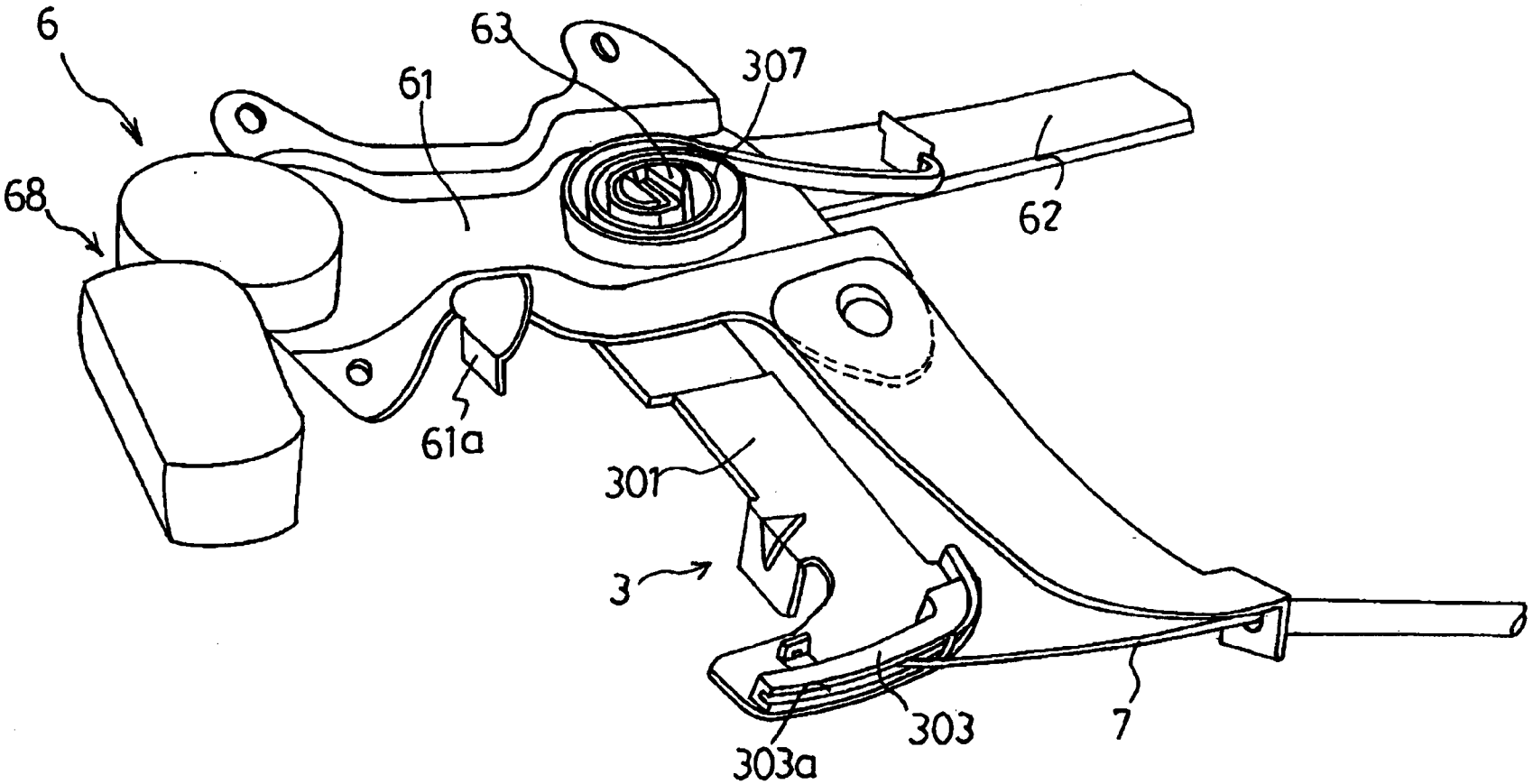
FIG. 4 is a front view of a modified version of the opening condition detection mechanism that can be used in the window-opening/closing device shown in FIG. 3.

FIG. 4 illustrates a modified version of the opening condition detection mechanism 3. The opening condition detection mechanism 3, which is unitized with the window regulator mechanism 6, includes as its main elements a rotation lever 301 and a detection cam 303. The rotation lever 301 is mounted for rotational movement on the pin 63. The lift arm 62 is also mounted for rotational movement on the pin 63. The pin 63 is supported by the base plate 61 so as to be rotated together with the rotational lever 301. A spiral spring 307 is mounted on the pin 63 so that one end portion of the spiral spring 307 is engaged with the pin 63 while the other end portion of the spiral spring 307 is engaged with the lift arm 62. Thus, the spiral spring 307 allows concurrent rotations of the rotational lever 301 and the lift arm 62.

The detection cam 303 is secured to the distal end portion of the rotational lever 301. The detection cam 303 is provided at its periphery with a cam groove 303*a* with which the connecting cable 7 is in sliding engagement.

If the window regulator mechanism 6 is driven to lower the pane 2 for purposes of opening the window portion 19 of the slide door 1, the lift arm 62 rotates in the clockwise direction in FIG. 4, and the spiral spring 307 brings the rotation lever 301 and the lift arm 62 into unitary rotation in the clockwise direction in FIG. 4. As a result, the connecting cable 7 slides in the cam groove 303*a*. Then, the detection cam 303 pulls the connecting cable 7, thereby activating the stopper mechanism 4. Thus, as mentioned above, the slide door 1 is prevented from being brought into its fully opened condition. In other words, so long as the window portion 19 is opened, the fully opened condition of the slide door 1 cannot be established. This makes it possible for the occupant to relatively easily check whether the window portion 19 is opened or not. In the event the connecting cable 7 becomes immovable due to an unexpected condition, the lift arm 62 causes the spiral spring 37 to bend or deflect, thereby allowing relative rotation of the lift arm 62 relative to the rotation lever 301. Thus, the rotation lever 301 is not susceptible to being deformed. It is to be noted that ultimately the rotation of the rotation lever 301 is regulated by engagement with a stopper wall 61*a* formed at the base plate 61 and thereafter only the lift arm 62 which continues to bend the spiral spring 307 rotates relative to the rotation lever 301.

Figure 5:
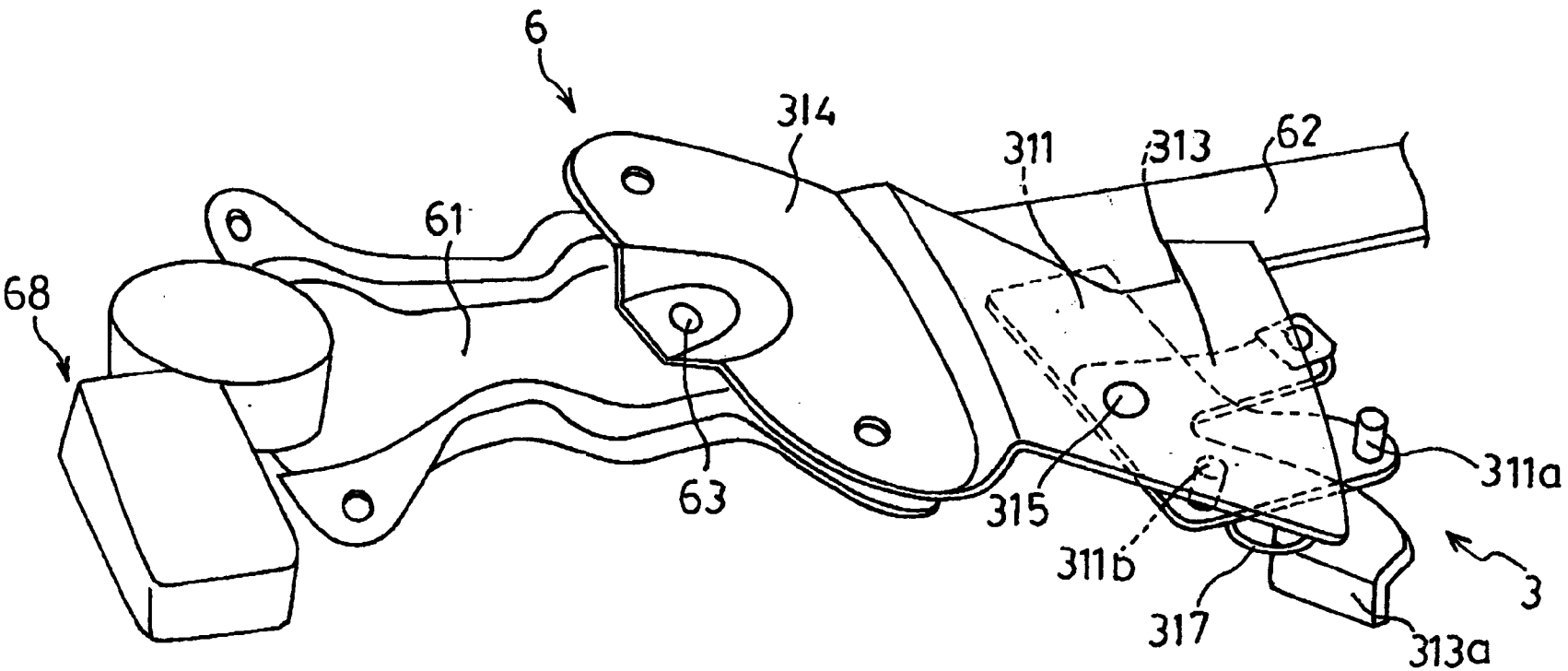
FIG. 5 is a front view of another modified version of the opening condition detection mechanism that can be used in the window-opening/closing device shown in FIG. 3.

Another modified version of the opening condition detection mechanism 3 is shown in FIG. 5. The opening condition detection mechanism 3, which is unitized with the window regulator mechanism 6, includes as its major elements a rotation lever 311 and a bell crank lever 313. The rotation lever 311 is secured to the lift arm 62 by welding or other means. The distal end portion of the rotation lever 311 is provided with a pair of spaced apart upstanding pins 311*a*, 311*b*.

The bell crank lever 313 is rotatably mounted on a pin 315 upstanding from a bracket 314 secured to the base plate 61. One end portion of the bell crank lever 313 is formed with a flange 313*a* which is engageable with the pins 311*a*, 311*b* of the rotation lever 311. The other end portion of the bell crank lever 313 is connected with the connecting cable 7. The bell crank lever 313 is continually rotationally urged by a turnover spring 317 disposed between the bell crank lever 313 and the bracket 314.

While the window portion 19 of the slide door 1 is being closed by the pane 2, the turnover spring 317 urges and holds the bell crank lever 313 at a position so as to establish a coincidence of the flange 313*a* of the bell crank lever 311 with the locus of the pin 311*a* of the rotation lever 311. If the window regulator mechanism 6 is driven to lower the pane 2 for purposes of opening the window portion 19 of the slide door 1, the resultant rotation of the lift arm 62 in the clockwise direction in FIG. 5 causes concurrent rotation of the rotation lever 311. This causes engagement of the pin 311*a* with the flange 313*a* of the bell crank lever 313. Thus, the bell crank lever 313 with turning the turnover spring 317 over is rotated in the clockwise direction in FIG. 5. As a result, the connecting cable 7 is pulled, thus activating the stopper mechanism 4. Thus, as mentioned above, the slide door 1 is prevented from being brought into its fully opened condition. In other words, so long as the window portion 19 is opened, the fully opened condition of the slide door 1 cannot be established. This makes it possible for the occupant to relatively easily check whether the window portion 19 is opened or not. It is to be noted that the turnover action of the turnover spring 317 caused by the rotation of the bell crank lever 313 is along the locus of the flange 313*a* of the bell crank lever 311.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A device in combination with a window portion of a slide door of a vehicle for opening and closing the window portion comprising:

a window regulator mechanism including a lift arm supporting a pane and a driving mechanism for moving the pane in downward and upward directions when the driving mechanism rotates the lift arm in opposite directions to effect opening and closing of the window portion;

an opening condition detection mechanism that includes a movable member operatively associated with the lift arm for movement together with the lift arm and a detection member linked to the movable member to indicate whether or not the window portion is closed by the pane;

an urging member operatively associated with the detection member for applying an urging force to the detection member; and wherein the movable member includes a cam plate secured to the lift arm, the cam plate possessing a cam surface, the detection member being positioned adjacent to the cam plate and including a rotatable first lever which is brought into contact with the cam surface of the cam plate by the urging member.

2. A device in combination with a window portion of a slide door as set forth in claim 1, wherein a portion of the lift arm engages the driving mechanism so that driving operation of the driving mechanism rotates the lift arm.

3. A device in combination with a window portion of a slide door as set forth in claim 2, wherein the portion of the lift arm that engages the driving mechanism is a gear.

4. A device in combination with a window portion in a slide door of a vehicle for opening and closing the window portion comprising:

a lift arm supporting a pane and a driving mechanism operatively connected to the lift arm to rotate the lift arm in opposite directions under driving operation of the driving mechanism to move the pane in downward and upward directions and effect opening and closing of the window portion; and an opening condition detection mechanism that includes a movable member, means for causing the movable member to rotate simultaneously with the lift arm under the driving operation of the driving mechanism, and a detection member engageable with the movable member during rotation of the lift arm to indicate whether or not the window portion is closed by the pane.

5. A device in combination with a window portion of a slide door as set forth in claim 4, wherein the means includes the movable member being connected to the lift arm.

6. A device in combination with a window portion of a slide door as set forth in claim 4, wherein a portion of the lift arm engages the driving mechanism to rotate the lift arm.

7. A device in combination with a window portion of a slide door as set forth in claim 6, wherein the portion of the lift arm that engages the driving mechanism is a gear.

8. A device in combination with a window portion of a slide door as set forth in claim 7, wherein the movable member possesses a cam surface engageable by the detection member.

9. A device in combination with a window portion of a slide door as set forth in claim 4, wherein the movable member includes a first lever operatively associated with the lift arm via an urging member, the first lever and the lift arm having a common rotation axis, the detection member including a detection cam secured to the first lever.

10. A device in combination with a window portion of a slide door as set forth in claim 4, wherein the movable member includes a rotation lever secured to the lift arm, the detection member including a detection lever, said detection lever being positioned adjacent to the rotation lever, whereupon when a portion of the detection lever is engaged with the rotation lever, the detection lever rotates.

11. A device in combination with a window portion of a slide door as set forth in claim 4, wherein the movable member includes a cam plate secured to the lift arm, the cam plate possessing a cam surface, the detection member being positioned adjacent to the cam plate and including a rotatable first lever which is brought into contact with the cam surface of the cam plate by the urging member.

12. A device in combination with a window portion in a lateral slide door of a vehicle for opening and closing the window portion comprising:

a lift arm supporting a pane and a driving mechanism engaging a portion of the lift arm to rotate the lift arm in opposite directions under driving operation of the driving mechanism to move the pane in downward and upward directions and effect opening and closing of the window portion; and an opening condition detection mechanism that includes a movable member mounted on the lift arm to rotate together with the lift arm under the driving operation of the driving mechanism and a detection member engageable with the movable member during rotation of the lift arm to indicate whether or not the window portion is closed by the pane.

13. A device in combination with a window portion in a lateral slide door of a vehicle as set forth in claim 12, wherein the portion of the lift arm engaging the driving mechanism is a gear.

14. A device in combination with a window portion in a lateral slide door of a vehicle as set forth in claim 12, wherein the movable member possesses a cam surface engageable by the detection member.

15. A device in combination with a window portion in a lateral slide door of a vehicle as set forth in claim 12, wherein the movable member includes a cam plate secured to the lift arm, the cam plate possessing a cam surface, the detection member being positioned adjacent to the cam plate and including a rotatable first lever which is brought into contact with the cam surface of the cam plate by the urging member.

16. A device in combination with a window portion in a lateral slide door of a vehicle as set forth in claim 12, wherein the movable member includes a first lever operatively associated with the lift arm via an urging member, the first lever and the lift arm having a common rotation axis, the detection member including a detection cam secured to the first lever.

17. A device in combination with a window portion in a lateral slide door of a vehicle as set forth in claim 12, wherein the movable member includes a rotation lever secured to the lift arm, the detection member including a detection lever, said detection lever being positioned adjacent to the rotation lever, whereupon when a portion of the detection lever is engaged with the rotation lever, the detection lever rotates.

18. A device adapted to be used with a window portion in a lateral slide door of a vehicle to open and close the window portion comprising:

a lift arm adapted to support a pane;

a driving mechanism engaging a portion of the lift arm to rotate the lift arm in opposite directions under driving operation of the driving mechanism and adapted to move the pane in downward and upward directions for opening and closing the window portion; and an opening condition detection mechanism adapted to indicate whether or not the window portion is closed and including a movable member mounted on the lift arm to rotate together with the lift arm under the driving operation of the driving mechanism and a detection member engageable with the movable member and moved by a relative displacement between the window portion and the movable member during rotation of the lift arm.

19. The device as set forth in claim 18, wherein the portion of the lift arm engaging the driving mechanism is a gear.

20. The device as set forth in claim 18, wherein the movable member possesses a cam surface engageable by the detection member.

21. The device as set forth in claim 18, wherein the movable member includes a cam plate secured to the lift arm, the cam plate possessing a cam surface, the detection member being positioned adjacent to the cam plate and including a rotatable first lever which is brought into contact with the cam surface of the cam plate by the urging member.

22. The device as set forth in claim 18, wherein the movable member includes a first lever operatively associated with the lift arm via an urging member, the first lever and the lift arm having a common rotation axis, the detection member including a detection cam secured to the first lever.

23. A device as set forth in claim 18, wherein the movable member includes a rotation lever secured to the lift arm, the detection member including a detection lever, said detection lever being positioned adjacent to the rotation lever, whereupon when a portion of the detection lever is engaged with the rotation lever, the detection lever rotates.

24. A device according to claim 18, wherein the lift arm comprises:

two arms connected by a pin, each of the two arms connected to a rail which is adapted to support the pane.

* * * * *